United States Patent [19]

Saputo

[11] Patent Number: 4,671,158

[45] Date of Patent: Jun. 9, 1987

[54] DRUM RESONANCE ELIMINATOR

[76] Inventor: Peter Saputo, 29504 Dover, Warren, Mich. 48093

[21] Appl. No.: 804,605

[22] Filed: Dec. 4, 1985

[51] Int. Cl.[4] ..... G10G 7/00
[52] U.S. Cl. ..... 84/411 M
[58] Field of Search ..... 84/411–420

[56] References Cited

U.S. PATENT DOCUMENTS

| | | | |
|---|---|---|---|
| 573,320 | 12/1896 | Boulanger | 84/411 M |
| 1,579,893 | 4/1926 | Simpson | 84/411 M |
| 3,433,115 | 3/1969 | Kjelstrom | 84/411 R |
| 3,453,924 | 7/1969 | Glick et al. | 84/411 |
| 4,154,137 | 5/1979 | Kobayashi | 84/411 R |
| 4,244,266 | 1/1981 | Hardy | 84/411 M |
| 4,246,825 | 1/1981 | Hodas | 84/415 |
| 4,325,280 | 4/1982 | Hardy | 84/411 M |
| 4,325,281 | 4/1982 | Hardy | 84/411 M |
| 4,520,709 | 6/1985 | Kester | 84/415 |

FOREIGN PATENT DOCUMENTS

| | | | |
|---|---|---|---|
| 74017 | 12/1976 | Japan | 84/411 M |

*Primary Examiner*—Lawrence R. Franklin
*Attorney, Agent, or Firm*—Basile, Weintraub & Hanlon

[57] ABSTRACT

A resonance eliminator for a drum head. The resonance eliminator includes a body having a first and second pivotally connected sections. A clamp is provided for detachably mounting the first section of the body on the rim of a drum. The resilient pad is attached to the second section of the body and engages the surface of the drum to eliminate resonance of the drum head caused by vibrations from the drum set itself or external sources. The second section is pivotal with respect to the first section to enable normal sounds to be exhibited by the drum head during play of the drum. Counterweight means are provided in one embodiment to insure that the second section of the body remains in a predetermined positional relationship with respect to the first section of the body. The latter embodiment is suitable for use on the bottom drum head.

11 Claims, 3 Drawing Figures

DRUM RESONANCE ELIMINATOR

BACKGROUND OF THE INVENTION

1. Field of the Invention

This invention relates, in general, to musical instruments and, more specifically, to drums.

2. Description of the Prior Art

In a band, orchestra, etc., it is typical to have one or more drum sets, each including several drums, as well as, several electrically amplified instruments, such as guitars, keyboards, etc. The individual drums, the amplifiers and other instruments themselves, create vibrations during play which result in undesirable and extraneous vibrations or "ringing" in each of the drums in the set.

A variety of devices have been proposed to mute or eliminate such external ringing or vibrations in drums. Such devices typically include a resilient body which is mounted or clamped on the drum head. While muting a drum from external ringing or vibrations, such muting devices also affect the sound of the drum. Drummers have also been known to utilize tape and other materials to deaden the drum. Again, however, this affects the overall sound or tone of each drum.

Thus, it would be desirable to provide a means to eliminate undesirable vibrations or ringing of a drum without affecting the sound or tone of the drum during play. It would also be desirable to provide such a vibration or "ring" eliminator which is easily adjustable depending upon the surrounding playing conditions and the drummer's preference. Finally, it would be desirable to provide a vibration or "ring" eliminator which is usable on any type of drum.

SUMMARY OF THE INVENTION

The present invention is a drum resonance eliminator which eliminates undesirabie vibrations or ringing in a drum caused by surrounding drums, other instruments, or amplifiers. The resonance eliminator includes a body having first and second sections which are pivoially connected together. A set screw threadingly extends through the first section and contacts the upper surface of the second section. This enables the spacing hetween the first and second sections to be varied as required.

Means are provided for clamping one of the sections to the rim of the drum such that the second section overlays the first section of the body and is able to exhibit pivotal movement with respect to the first section of the body. A resilient pad is attached by means of an elongated rod to the first section and is disposed in contact with the surface of the drum head for damping out and eliminating any resonance or vibrations which may be created in the drum head.

Due to the pivotal arrangement of the second section with respect to the first section of the body, the resilient member and the second section are able to exhibit pivotal movement with respect to the first section which is clamped on the rim of the drum head. This enables the resilient member to move off the surface of the drum head during normal play of the drum such that the ione and/or sound of the drum remains unchanged during normal play; and yet, vibrations of the drum caused by surrounding drums or other external sources is eliminated when the drum is not being played.

The drum resonance eliminator of the present invention is of simple construction so as to be attachable to any type of drum. It is also adjustable to vary the pressure exerted on the drum head by the pad for various playing conditions and the desired sound. Most importantly, the drum resonance eliminator of the present invention besides eliminating undesired resonance or vibration of a drum also enables the tone and/or sound of the drum to remain unchanged during normal play of the drum.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
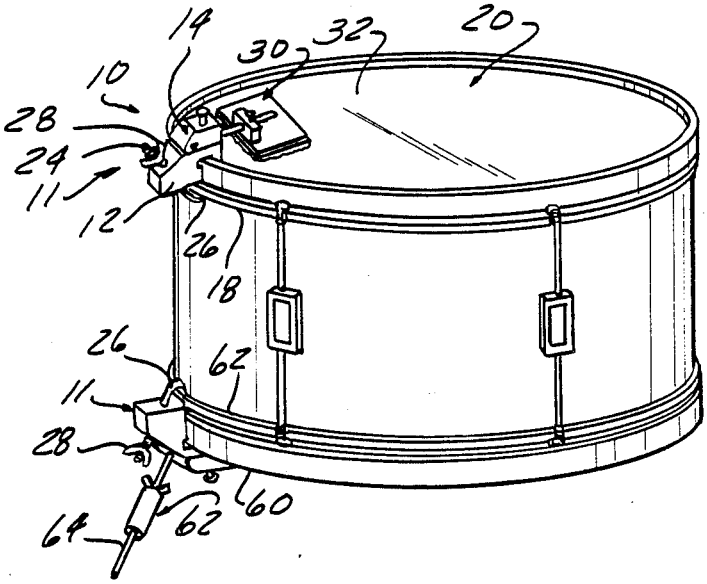
FIG. 1 is a perspective view of the drum resonance eliminator of the present invention shown in two different embodiments mounted on a typical drum.

Throughout the following description and drawing, an identical reference number is used to refer to the same component shown in multiple figures of the drawing.

Figure 2:
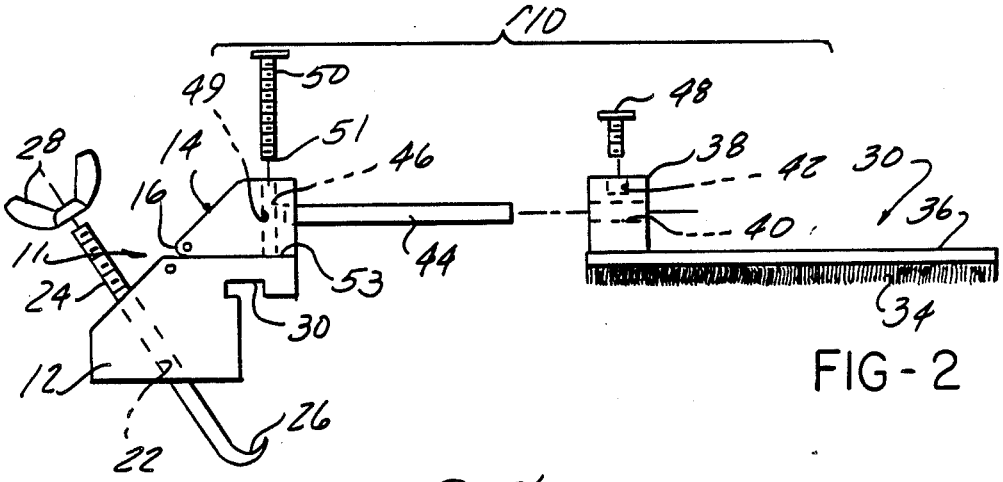
FIG. 2 is an exploded, side view of one embodiment of the drum resonance eliminator of the present invention.
Figure 3:
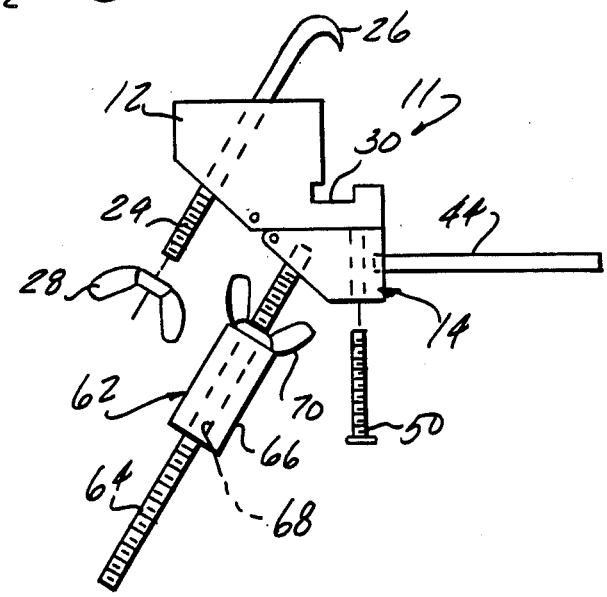
FIG. 3 is a partial side view of &he oiher embodiment of the drum resonance eliminator of the present invention.

As shown in FIGS. 1, 2 and 3, there is disclosed a drum resonance eliminator 10 constructed in accordance with the teachings of the present invention. The drum resonance eliminator 10 is devised to eliminate any vibration of the drum head caused by vibrations from other drums in the drum set or from external sources, such as surrounding musical instruments, amplifiers, etc.

The drum resonance eliminator 10 is formed with a body 11 having first and second sections 12 and 14, respectively. The first and second sections 12 and 14 are pivotally connected together by means of a hinge which may comprise any type of conventional hinge, such as a leaf hinge, piano hinge or living hinge if the first and second sections are formed of a plastic material. It is also possible to form the first and second sections 12 and 14 of the body 11 of any convenient material, such as plastic, wood, metal, etc.

The shape of the first and second sections 12 and 14 shown in FIGS. 1 and 2 is selected for aesthetic purposes only. It will be understood that shapes other than that illustrated in FIGS. 1 and 2 may also be employed. However, it is preferred that the outermost end 16 of the first sections 14 be formed with a curved or arcuate shape 16. This permits easy pivotal movement of the second section 14 with respect to the first section 12.

Means are provided for mounting the first section 12 of the drum resonance eliminator on the rim 18 of a conventional drum 20 shown in FIG. 1. In a preferred embodiment, the mounting means includes a through bore 22 in the first section 12 of the body 11. An elongated, threaded rod 24 having a hook-like end portion 26 is inserted through the bore 22 with the threads extending outward from one side of the first section 12. A threaded fastener, such as a wing nut 28, is threadingly engagable over the threaded portion of the rod 24 to enable the rod 24 to be hooked over the rim 18 of the drum 20 and brought into secure engagement there-with. A notch 30 is formed in the interior surface of the first section 12 and is sized to engage the upper portion of the drum rim 18 and thereby hold the drum resonance eliminator body 11 in a secure position on the rim 18 of the drum 20.

Due to the different rim shapes found on drums from different manufacturers, a unique drum resonance eliminator 10 having a notch 30 shaped to the particular rim configuration of each different drum may be required. Alternately, however, small inserts or wedges may be used to conform the notch 30 in FIG. 3 to the required rim configuration.

The elongated rod 44 is secured in a bore 46 formed in the second section 14 of the body 11 to rigidly mount the rod 44 to the body 11.

A vertically extending threaded bore 49 is formed in the second section 14 of the body 11 adjacent to and spaced from the bore 46 which receives one end of the rod 44. An elongated threaded fastener 50, such as a set screw, may be positioned at any desired position within the threaded bore 49. The outermost end 51 of the fastener 50 engages the upper surface 53 of the first section 12 and enables the position of the second section 14 to be adjusted with respect to the first section 12 from a flush mating engagement to a spaced, angular position, not shown.

This positioning of the fastener 50 also results in a change in contact between the resilient member 34 of the drum head engagement means 30 on the drum head surface 32 of the drum 20. This enables the drummer to set the muting characteristics of the drum head resonance eliminator 10 of the present invention to any desired condition depending upon the surrounding equipment, playing conditions or the sound the drummer wants to achieve while playing the drum 20. Such repositioning of the resilient member 34 with respect to the drum head surface 32 could result in a total elimination of the muting characteristics and a change in the sound of the drums as desired by the drummer or may be placed into a slight contact position with the drum head surface 34 to enable the drum head engagement means 30 to effectively "breathe" with respect to the drum head surface 32.

In use, the support member 36 carrying the resilient pad 34 is inserted over the rod 44 and the rod 44 mounted on the second section 14 of the body 11. The set screw 48 is tightened to secure the support member 30 at the desired position over the drum head 32. The fastener 50 is then adjusted to bring the pad 34 into the desired amount of contact with the drum head 32. This will bring resilient member 34 into pivotal engagement with the drum head 32 and eliminate undesired vibration or ringing of the drum head 32 caused by other drums, surrounding musical instruments, or amplifiers. However, during the normal play of the drum, the normal vibrations of the drum head 32 cause the resilient member 34 to pivot upward about the hinge 16 between the first and second sections 12 and 14 of the body 11 thereby enabling normal sounds or tones to be produced from the drum 20.

Another embodiment of the drum resonance eliminator 10 is shown in FIG. 3. In this embodiment the body 11 is formed identically with that described above insofar as including a notch 30 for securement over the rim 60 on the bottom of the drum 20 and a hook 26 which engages the bottom rim 62 of the drum 20.

A counterweight means denoted in general by referenoe number 62 is shown in FIG. 3 for biasing the second section 14 of the body 11 upwards so as to urge the resilient pad 34 attached to the rod 44 into engagement with the bottom drum head surface when the drum 20 is not being played. The counterweight means 32 includes an elongated threaded rod 64 which is mounted in the second section 14 of the body 11. A weight 66 including an internal threaded bore 68 is selectively positionable along the threaded rod 64 and secured in the selected position by a threaded fastener, such as a wing nut 70. This position may be changed as necessary depending upon the drummer's preference and the surrounding conditions.

In summary, there has been disclosed a unique drum resonance eliminator which eliminates the resonance or vibration of the drum head caused by other drums, surrounding musical instruments, amplifiers, etc. The drum resonance eliminator of the present invention is simply constructed for easy attachment to any type of drum and may be adjusted to provide any desired amount of resonance suppression. Most importantly, the drum resonance eliminator of the present invention enables the sound and/or tone of the drum to remain true or normal since the resilient pad which contacts the drum head pivots off of the drum head during normal play of the drum.

What is claimed is:

1. A drum resonance eliminator comprising a body formed of first and second sections;

means for detachably mounting the first section of the body to the drum;

a resilient member engageable with the outer surface of the drum head;

a support member attached to the second section of the body and carrying the resilient member; and means for pivotally mounting the first and second sections of the body to enable the resilient member to pivot away from the outer surface of the drum head when the drum head is struck but maintains the resilient member in contact with the outer surface of the drum head when the drum head is not being struck to eliminate resonance of the drum head by external vibrations.

2. The drum resonance eliminator of claim 1 further including a rod mounted in and extending outward from the second section of the body.

3. The drum resonance eliminator of claim 2 further including means for adjustably connecting the rod to the second section of the body.

4. The drum resonance eliminator of claim 3 wherein the adjustable connecting means comprises:

a fastener engagable through the second section of the body and the rod.

5. The drum resonance eliminator of claim 4 further including a notch form in the body for engaging the drum.

6. The drum resonance eliminator of claim 1 further including:

counterweight means attached to the second section of the body for maintaining the second section of the body in a predetermined normal positional relationship with respect to the first section of the body.

7. The drum resonance eliminator of claim 6 wherein the counterweight means comprises:

a threaded shaft mounted within the second section of the body and extending outward therefrom;

weight means selectively positionable along the length of the threaded shaft; and fastener means for securing the weight means at a predetermined position along the length of the threaded shaft.

8. The drum resonance eliminator of claim 1 further comprising:

means for adjusting the angular position of the second section of the body with respect to the first section.

9. The drum resonance eliminator of claim 8 wherein the adjustably positioning means comprises:

a threaded bore formed in the second section of the body;

a threaded fastener threadingly engaging the rod and movable therethrough, one half of the threaded fastener being adjustably engagable with the first section of the body to selectively alter the pivotal position of the second section of the body with respect to the first section.

10. A drum resonance eliminator comprising:

a body formed of first and second sections;

hinge means for pivotally joining the first and second sections together, said second section being gravitationally biased toward said first section;

means for detachably mounting the first section of the body on a drum adjacent the drum head;

a threaded bore formed in the second section of the body;

a threaded fastener threadingly movable within the bore and engagable with the first section of the body at one end of the bore for adjustably positioning the angular spacing between the first and section sections of the body;

a resilient member engagable with the surface of the drum head;

a support member carrying the resilient member; and a rod mounted in and extending outward from the second section of the body, the rod being slidingly received within and attachable to the second section of the body.

11. The drum resonance eliminator of claim 10 further including:

counterweight means attached to the second section of the body for maintaining the second section of the body in a predetermined positional relationship with respect to the first section of the body.

* * * * *